United States Patent [19]

Newton

[11] Patent Number: 4,506,583

[45] Date of Patent: Mar. 26, 1985

[54] AUTOHARP

[76] Inventor: William T. Newton, 6412 Green Valley Rd., Knoxville, Tenn. 37914

[21] Appl. No.: 619,705

[22] Filed: Jun. 14, 1984

Related U.S. Application Data

[63] Continuation of Ser. No. 380,541, May 21, 1982, abandoned.

[51] Int. Cl.[3] ..... G10D 1/12

[52] U.S. Cl. ..... 84/287

[58] Field of Search ..... 84/285-289

[56] References Cited

U.S. PATENT DOCUMENTS

| | | | |
|---|---|---|---|
| 559,124 | 4/1896 | Durkee | 84/287 |
| 559,764 | 5/1896 | Back | 84/287 |
| 572,010 | 11/1896 | Hibshman | 84/288 |
| 625,996 | 5/1899 | Young | 84/288 |
| 2,473,442 | 6/1949 | Page | 84/287 |

*Primary Examiner*—Lawrence R. Franklin

*Attorney, Agent, or Firm*—James C. Kesterson

[57] ABSTRACT

A new autoharp allowing greater versatility of sounds by allowing individual control of the strings of an octave is disclosed. This invention is for use with string musical instruments such as the autoharp having a resonating box (12) which has a multiplicity of strings (14, 16, 18, and 20) adapted for vibration running transverse to the resonating box (12). Improvement to the autoharp comprises a pair of support means (40) and (42) mounted to the resonating box (12) parallel to the multiplicity of strings. The support members (40) and (42) are further located such that the multiplicity of strings are located between the pair of support members (40) and (42). A multiplicity of octave bars such as octave bar (62) is supported by and extends between each of the pair of support members (40) and (42) such that the octave bar (62) is above and perpendicular to the vibrating strings. Each of the octave bars such as octave bar (62) is associated with a selected note in each of a plurality of octaves. A plurality of control members such as control member (70) are attached to each of the octave bars and their number is equal in number to the number of octaves containing the selected note. Each of the control members (70) extends from the bottom portion (74) of the octave bar through the parallel vibrating strings to a lower portions (72) which supports a dampening pad (76) located below the string. A pair of resilient means such as springs 90 and 92 are also included for urging the dampening pad (76) against the strings. According to a preferred embodiment, each of the octave bars such as octave bar (62) defines a threaded aperture (126) suitable for receiving a threaded adjusting screw (116). Screw (116) is located at each end of the octave bar in such a manner so that the distance the octave bar (62) may be depressed may be controlled. This control is achieved by the use of a small screwdriver which passes through aperture (122) of top portion (104) to provide access to slot (124) of the adjusting screw (116).

8 Claims, 5 Drawing Figures

AUTOHARP

This application is a continuation, of application Ser. No. 380,541, filed May 21, 1982, now abandoned.

DESCRIPTION

1. Technical Field

This invention relates generally to multistringed musical instruments, and more particularly to such instruments generally referred to as autoharps. Unlike the standard autoharp which includes chord bars and which only allows selected chords to be played, the autoharp of this invention includes a keyboard which allows the operator or performer to selectively play any string or strings he chooses, thereby providing a substantial increase in the versatility of the instrument.

2. Background Art

The standard autoharp is a portable stringed instrument by wwhich musical chords are played by strumming the strings while depressing chord keys. U.S. Pat. No. 257,808 issued to Zimmerman discloses an early example of this instrument which is provided with a multiplicity of strings arranged in a number of octaves over a resonating box. A series of chord bars extends across the strings a slight distance above them, such that all of the strings are normally in an undamped condition. Each of the chord bars are provided with a series of dampening pads which engage selected strings when the chord bar is depressed. Thus, only certain of the strings are free to vibrate or give sound when strummed or picked. Further, the dampening is selected such that when a particular chord bar is depressed only those selected strings which constitute the notes in that chord are free to vibrate.

Thus, it will be appreciated that the number of chords that can be played on the standard autoharp are limited by the number of available chord bars. This normally ranges from a low number of fifteen to a high number of twenty-seven chord bars. However, it will be appreciated that if only the lower number of fifteen chord bars are available then the autoharp will be limited in that only fifteen separate chords can be played which of course means that there will be times that the autoharp must be silent. On the other hand, if the large number of twenty-seven chords is used the chord bars cover such a large portion of the overall playing surface of the autoharp the performer has only a small or cramped area in which to strum or pick the desired strings. Consequently, it can be seen that according to the standard autoharp the improvisation of chords or sounds is very limited. Consequently, the performer is limited to playing a limited number of chords on the standard autoharp or not playing at all.

There have, however, been improvements to the basic or standard autoharp such as disclosed in the Zimmerman patent discussed above. For example, the Wigand U.S. Pat. No. 390,830; the Back U.S. Pat. No. 559,764 issued May 5, 1896; the Young U.S. Pat. 625,996 issued May 30, 1899 and the Aronis U.S. Pat. No. 4,175,466 issued Nov. 27, 1979, each disclose patents wherein rather than the use of chord bars, each bar is associated with certain fundamental notes. When operated these bars hereinafter referred to as note bars provide for dampening the vibrations of all the other strings.

For example, the Wigand device used dampening elements which damp vibrations of all strings comprising a particular note including its harmonics or octaves. On the other hand the Back Patent discloses a keyboard which has the appearance of one octave of a piano keyboard and which operates such that the strings are undampened all of the time except when a particular note or key is depressed representing a particular note. At the time of pressing any key, all strings are dampened except the strings associated with the key being depressed. The strings representing those notes remain undampened when the key is depressed such that strumming across the strings will result in that note only being played. The Young Patent operates in a similar manner, and although these patents have advantages over the standard autoharp, and also have some similarity to the present invention, the keyboard mechanism is extremely complex, expensive, and difficult to manufacture.

The Aronis patent also operates in a manner similar to the Back and Young patents, except that the keyboard is removed from across the top or body of the strings to the side of the instrument such that the full stringed area is available for strumming or playing. However, just as was the case with the Back and Young patents, the Aronis keyboard arrangement is complex and expensive to incorporate.

Thus, it can be seen that although there have been improvements to the standard autoharp which allow greater versality for playing the instrument such as does the present invention, these improvements are complex and do not allow for the simple retrofitting of the standard autoharp with a keyboard to allow the uninhibited play of the instrument.

Therefore, it is an object of the present invention to provide a simple, and inexpensive improvement of an autoharp which allows the unrestricted playing of notes and melodies.

It is another object of this invention to provide a piano-like keyboard which allows the autoharp to be strummed and individual notes played as with the piano.

Still another object of the present invention is to provide apparatus for retrofitting a standard autoharp with the note bars such that individual notes may be played.

DISCLOSURE OF THE INVENTION

Other objects and advantages will in part be obvious, and will in part appear hereinafter, and will be accomplished by the present invention which provides for an improvement in the multi-stringed instrument such as the autoharp. The improvement is for use with the autoharp to provide a keyboard for allowing selective sounding of individual strings, and which comprises a resonating box of a selected size and shape. The multiplicity of sounding strings which are adapted for vibration are each attached by their two ends so as to be parallel to each other and to transverse the box. The tension of each string can be adjusted to provide a selected sound from the combination vibrating string and resonating box so that each one of the multiplicity of strings can be tuned to provide notes arranged in a plurality of octaves. The improvement of this invention comprises a pair of support means which are mounted to the resonating box parallel to the multiplicity of vibrating strings. These pair of supports means being further mounted so that all of the multiplicity of the parallel strings are between the parallel pairs of support means. The multiplicity of octave bars are supported by and extend between each of the pair of support means such that the octave bars are above and perpendicular to the vibrating strings. Each of the octave bars further being associated with a selected note in each of the plurality of octaves, and each of the octave bars further includes a plurality of control members equal in number to the number of octaves containing the selected note. Futhermore, each of the control members extends from the octave bar through the strings to a dampening portion on the control member which portion is located below the string corresponding to the selected note. A resilient means such as a spring cooperates with the octave bars to normally urge the dampening portion of the control members against the selected strings such that when a selected bar is depressed the particular string or strings corresponding to the selected note is undamped and is free to vibrate upon being plucked or strummed. A further embodiment of this invention includes threaded apertures defined in each end of the octave bars which extend through the octave bar from the topside to the bottomside. This threaded aperture cooperates with an adjustable stop screw received by the aperture to allow adjustment of the spacing between the dampening portion of the control member and the individual strings when the octave bar is depressed. In addition, the preferred embodiment of this invention includes finger keys attached to the topside of each of the octave bars representative of the standard notes on a piano keyboard.

BRIEF DESCRIPTION OF THE DRAWINGS

The above mentioned features of the present invention will be more clearly understood from the consideration of the following description in connection with the accompanying in which.

BEST MODE FOR CARRYING OUT THE INVENTION

Figure 1:
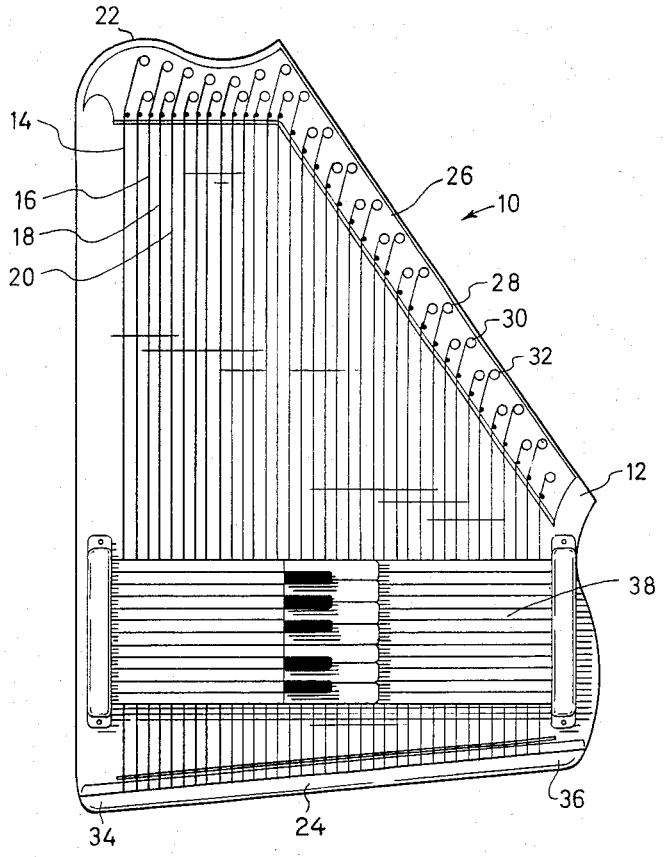
FIG. 1 is a perspective view of a keyboard autoharp incorporating the features of this invention.

Referring now to FIG. 1, there is shown generally at 10 a keyboard autoharp incorporating the features of this invention. As shown, the autoharp comprises a resonating box 12 having attached thereto a multiplicity of strings such as the strings represented by reference number 14, 16, 18, and 20 which extend over the top of the resonating box 12 from a first end 22 to a base end 24. As shown, the strings may vary not only in diameter but may also vary in length as is provided by the sloping portion 26 of the autoharp. In addition, the sound produced by each individual string may readily be varied by decreasing or increasing the tension on the string by means of the tuning pegs such as at 28, 30, and 32. Typically, it will be appreciated by those skilled in the art the autoharp normally comprises approximately 36 separate notes or strings which comprises portions of four (4) separate octaves of the standard notes including sharps and flats. As will be appreciated by those skilled in the art the standard keyboard with sharps and flats constitutes twelve total notes. Further, it will be appreciated that when the autoharp is properly tuned the strings will typically provide sounds extending across four consecutive octaves, such as the low octave sounds at side 34 to the highest octave sounds at side 36. Playing of the instrument is typically accomplished by either strumming across the face of the strings or in some instances individual picking may also be accomplished. Therefore, to assure the sounding of only selected ones of the strings when all of the strings are strummed, an autoharp further includes a dampening system 38 which may comprise a system of chord bars for the standard autoharp which only plays chords, or octave bars for an improved autoharp which allows sounds other than chords to be played. The dampening system 38 of the autoharp shown in FIG. 1 is an octave bar dampening system the details of which will be discussed hereinafter.

Figure 2:
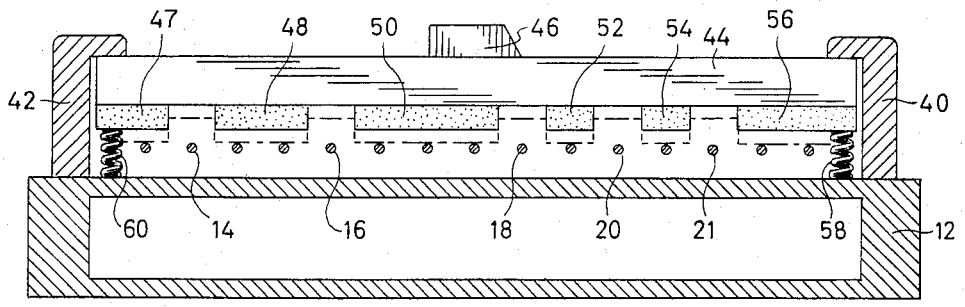
Fig. 2 PRIOR ART
FIG. 2 shows a cross-section of the prior art chord bar autoharp disclosing the operation of the typical chord bars.

Referring now to FIG. 2, there is shown a cross-sectional view of a typical prior art autoharp using a chord bar dampening system. As shown, the resonating box 12 of the autoharp has a multiplicity of strings such as strings 14, 16, 18, 20 and 21 transversing the resonating box 12. It will be appreciated, that although the typical autoharp may include approximately "36" strings, in the cross-sectional view of FIG. 2 and the cross-sectional view of FIG. 3 to be discussed hereinafter there is shown a substantially reduced number of strings for the purposes of illustration only. Mounted to the resonating box 12 of the standard autoharp are a pair of octave bar supports 40 and 42. These supports 40 and 42 contain a multiplicity of chord bars such as chord bar 44 shown in FIG. 2. Attached to the top side of a chord bar is an identifying finger key 46 to identify the chord which will be played if this select chord bar is selected or depressed. Attached to the body of the chord bar 44 are a series of dampening pads such as 47, 48, 50, 52, 54 and 56. The chord bar 44 and the multiplicity of dampening pads are normally maintained in the solid line position such that the pads are spaced a selected distance away from the individual strings to allow vibration thereof. In a typical embodiment of a standard autoharp, the chord bar 44 is maintained in its upward utmost position by means of compression springs 58 and 60. Thus, in operation if the chord represented by finger key 46 and chord bar 44 is to be played, the finger key is depressed such that the chord bar itself is lowered and the multiplicity of dampening pads move into contact with all of the strings except those particular strings which when sounded together will make up the desired chord. The dashed or phantom lines of the chord bar shows the chord bar in contact with the undesired strings. It will be appreciated, of course, that different chord bars allow the vibration of other combinations of strings such that the player may select the chord he desires by simply pushing the chord bar and strumming all of the strings which transverse the resonating box of the autoharp. However, it will be appreciated that although the player may pick any of the strings of the standard autoharp without depressing a chord bar to achieve a melody, he cannot strum the strings and produce a melody or particular selected sounds unless such a sound can be produced by one of the chord bars.

Figure 3:
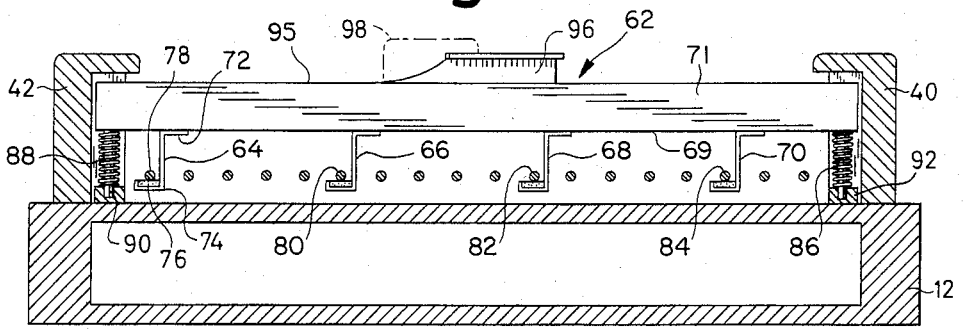
FIG. 3 discloses a cross-section of a keyboard autoharp incorporating the improved features of this invention.

Referring now to FIG. 3, there is shown a cross-sectional view of the keyboard autoharp incorporating the features of this invention. As shown, a multiplicity of strings are mounted above the resonating box 12 of the autoharp just as was done in the standard autoharp of FIG. 2.

Also as shown, the autoharp of this invention includes a pair of support members 40 and 42 which are aligned parallel to the multiplicity of strings and in such a manner so that the multiplicity of strings are located between the parallel supports 40 and 42. However, rather than using chord bars such as are used in the standard autoharp, the improved autoharp of this invention uses a group or multiplicity of octave bars such as shown at 62. Each of the octave bars such as octave bar 62 are associated with a particular note in an octave. Thus, it will be appreciated that the standard octave includes seven notes A through G and five sharp and flat notes for a total of twelve notes. Thus, if an autoharp contains portions of four octaves it will therefore contain separate strings representative of each of the twelve notes in the four separate octaves. Therefore, since each of the octave bars is associated with a particular note of an octave, it will be appreciated that there will only be twelve octave bars. Further, since each of the octave bars is associated with a selective note of each octave and since there are four octaves, there will also be no more than four strings corresponding to the selective note in each one of the octaves. Referring again to FIG. 3, it can be seen that the octave bar 62 further includes four control members 64, 66, 68, and 70 each of which is associated with a selected note in each octave, and each of which is rigidly attached to the bottom side 69 of longitudinal portion 71 of each octave bar. As shown, the control members 64 through 70 may be attached to the octave bar in any suitable manner such as by welding, bonding, or by means of a screw. It can also be seen that each of the control members 64 through 70 includes an upper portion 72 which is attached to the octave bar 62 and a lower portion 74 which includes a pad 76 adapted for bearing on or contacting the string associated with the selective note in each octave. Thus, as an example, if the octave bar 62 is considered to be the "C" note or octave bar then the strings 78, 80, 82, and 84 associated with the control members 64 through 70 will also be "C" strings. Resilient means such as the compression springs 86 and 88 are located at each end of the octave bar to urge the octave bar in an upward direction such that the pad 76 of the lower portion 74 of the various control members is in contact with the strings which would sound that note thereby preventing their vibration unless the octave bar is depressed.

In the embodiment shown in FIG. 3, there are also included a pair of stops 90 and 92 to control the distance that octave bar 62 may be depressed and thereby also control the spacing between the padding 76 of the lower portion 74 of the control members 64 through 70 and the associated strings. Without the stop posts 90 and 92, it will be appreciated that the octave bar could be pushed down so far that the bottom edge 69 of the octave bar could contact all of the strings, thereby defeating the purpose of the bar.

To identify the particular notes controlled by a selected octave bar, the topside 95 of longitudinal portion 71 of each octave bar preferably further defines or has rigidly attached thereto a finger contact portion or key portion 96 for the regular notes A through G and also a distinguishable sharp and flat key portion such as at 98 to identify the sharp and flat keys. Thus, as is shown in the autoharp of FIG. 1, the "keyboard" of this improved autoharp has the appearance of the standard piano keyboard.

Figure 4:
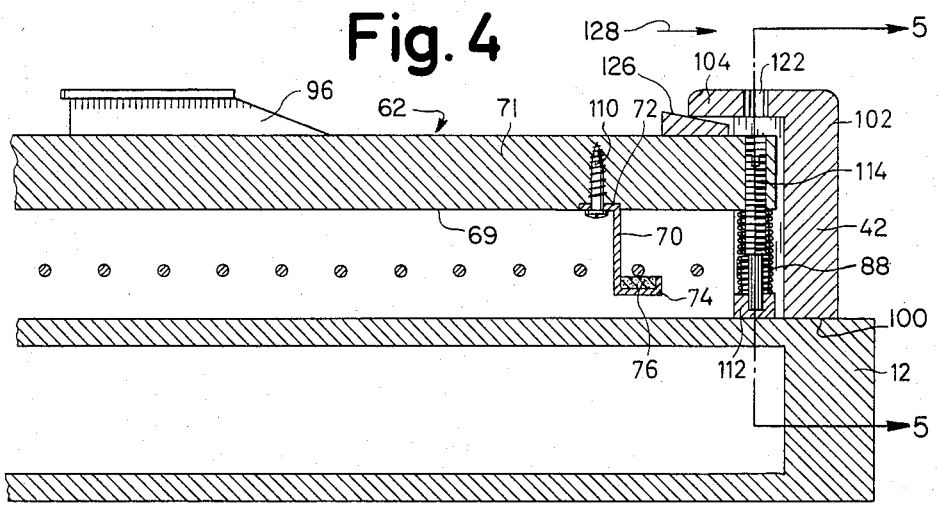
FIG. 4 is a further embodiment of the improved autoharp of this invention showing details of the support technique between the support members and the individual octave bars.
Figure 5:
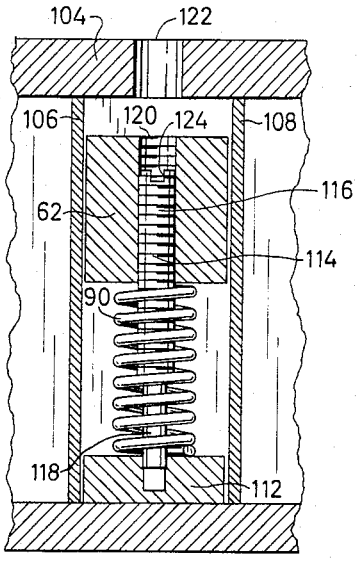
FIG. 5 is an enlarged cross-sectional view taken along line 5—5 of a portion of FIG. 4 showing the adjustable stop screw for adjusting the spacing between the undamped string and the dampening portion of the control member.

Referring now to FIGS. 4 and 5, there is shown an enlarged and detailed view of how each of the octave bars are supported and arranged by the support members. As shown, the support member 40 is firmly or permanently mounted at 100 to the resonating box 12. The support member 40 includes a side member 102 and a top member 104. In addition, in the autoharp of this invention there will be twelve octave bars. Support member 40 further includes a multiplicity of dividing strips such as shown at 106 and 108 of FIG. 5 to maintain each of the individual octave bar in a particular horizontal location. Also as shown in more detail in FIG. 4, the control members 64 through 70 may readily be attached at the upper portion 72 to the bottom side 69 of longitudinal portion 71 of octave bar 62 by means of a screw 110. In addition, the pad 76 located on the lower portion 74 of control member 70 can be seen in greater detail.

According to the preferred embodiment of FIGS. 4 and 5, there is also included a cupped shaped bearing member 112 associated with each end of each of the octave bars. A resilient means such as compression spring 86 is located between bearing member 112 and the bottom side 69 of longitudinal portion 71 of octave bar 62, one at each end. Further in this preferred embodiment, rather than using the stop post as shown in FIG. 3, the preferred embodiment includes adjustable spacing screws such as spacing screw 114 shown on octave bar 62. The spacing screw 114 includes a threaded portion 116 and a bearing portion 118. The threaded portion 116 of adjusting screw 114 is received by threaded aperture 120 defined in each end of the octave bars such as shown in octave bar 62. To facilitate the adjustment of the octave bar, according to this embodiment the top portion 104 of the support member 40 will define a series of apertures 122 located axially with the multiplicity of adjusting screws such that a screw driver may be fitted through the aperture 122 into the slot 124 of each adjusting screw thereby allowing the desired adjustment. Thus, it can be seen that by adjusting the adjustable stop screw 116 the downward travel distance of the octave bar 62 can be regulated such that the string 78 may be given clearance to vibrate but such that the travel of the octave bar 62 will not be sufficient to allow contact of the bottom of the bar itself with the multiplicity of strings.

Tuning of this improved autoharp cannot be accomplished in quite the same manner as the standard autoharp in that all of the strings will be damped unless the appropriate key is depressed. Therefore, tuning must take place by depressing the key associated with the desired note to allow the associated strings freedom to vibrate. However, it has been found that a pair of wedged shaped spacers such as spacer 126 may be placed under edge 104 of the support member and on top of the multiplicity of octave bars and pushed in the direction indicated by the arrow 128 such that all the octave bars are held in a depressed condition thereby allowing vibration of all the strings and ease of tuning.

Thus, it will be appreciated that there has been described to this point an improved autoharp with increased versatility and which provides a keyboard of simplicity and which is suitable for use with standard autoharps by retrofitting. Consequently, although the present invention has been described with respect to such specific methods to allow versatility of the autoharp, it is not intended that such specific references be considered limitations upon the scope of this invention except insofar as are set forth in the following claims.

I claim:

1. A multi-stringed Autoharp wherein all of the strings are normally dampened, and are selectively undampened during playing of the Autoharp by a keyboard, said autoharp comprising:

a hollow resonator box having a top side and a first and second end;

a multiplicity of sounding strings secured parallel to each other across said resonator box at said first and second ends and at a selected spacing above said top side, said multiplicity of strings tuned to provide notes arranged in a plurality of octaves;

a pair of support means mounted to said resonating box parallel to said multiplicity of strings, each one of said pair defining twelve equally spaced octave bar channels, and said pair being mounted so that said multiplicity of parallel strings are located between said parallel pair of support means such that each of said twelve channels of one of said pair opposes one of said channels in the other one of said pair;

twelve parallel octave bars, one each for each note in a standard octave and each octave bar including, a longitudinal portion having first and further ends and a top side and a bottom side, each of said first and further ends defining a threaded aperture extending through said longitudinal portion from said bottom side to said top side, and being supported by and extending between each of said pair of said support means such that said longitudinal portion is located above and perpendicular to said strings, and such that said first and further ends extend within one of said channels defined in one of said pair of support means and said opposing channel of said other one of said pair to maintain said octave bars parallel to each other, a key or finger contact portion rigidly attached to said top side of said longitudinal portion, a plurality of control members rigidly attached to said bottom side of said longitudinal portion and equal in number to the number of octaves containing said selected note, each of said control members extending from said bottom side of said octave bar through said strings to a dampening portion located below a string corresponding to said note, a plurality of dampening pads, one each attached to one each of said control members between said control member and said string, and adapted to dampen a vibrating string, one each of said longitudinal portion, finger contact portion and plurality of control members all operating together as a single rigid unit and comprising each of said octave bars;

twelve pairs of resilient members, one each of each of said pairs located in opposing channels defined in said pair of support means, and each one of said pair of resilient members cooperating with one each of said twelve octave bars, and operating to maintain said pads of an octave bar in a rest position against said sounding strings associated with the notes of said octave bar when said contact portion of said octave bar is not depressed and said octave bar is in its rest position, and such that said pads are moved to a playing position spaced from said strings by depressing said contact portion so as to move said octave bar to allow said string to vibrate when said note associated with said string is to be played, and said playing position of said octave bar being substantially parallel to said rest position; and an adjustable stop screw received by each of said threaded apertures for adjusting the distance said dampening pads can be spaced from said strings.

2. In a multi-stringed instrument having a resonating box of a selected size and shape, and a multiplicity of sounding strings adapted for vibration, each of said strings attached by their ends so as to be parallel to each other and to transverse said resonating box such that each string can be tuned to provide notes arranged in a plurality of octaves, the improvement comprising:

a pair of support means mounted to said resonating box parallel to said multiplicity of strings, said pair being mounted so that said multiplicity of parallel strings are located between said parallel pair of support means;

a multiplicity of octave bars, each of said multiplicity associated with a selected note in each one of said plurality of octaves, and each of said octave bars comprising, a longitudinal portion having first and further ends and a top side and a bottom side, each of said first and further ends defining a threaded aperture extending through said longitudinal portion from said bottom side to said top side, and being supported by and extending between each of said pair of said support means such that said longitudinal portion is located above and perpendicular to said strings, a key or finger contact portion rigidly attached to said top side of said longitudinal portion, a plurality of control members rigidly attached to said bottom side of said longitudinal portion and equal in number to the number of octaves containing said selected note, each of said control members extending from said bottom side of said octave bar through said strings to a dampening portion located below a string corresponding to said note, a plurality of dampening pads, one each attached to one each of said control members between said control member and said string, and adapted to dampen a vibrating string, one each of said longitudinal portion, finger contact portion and plurality of control members all operating together as a single rigid unit and comprising each of said octave bars;

a multiplicity of pairs of resilient members, one each of said pair at said first and further end of said longitudinal portion of each of said octave bars urging said pad of said dampening portion of said rigidly attached control member against said strings when said contact portion of said octave bar is not depressed and said octave bar is in its at rest position, and such that said pad of said dampening portion can be spaced from said string by depressing said contact portion so as to move said octave bar to allow said string to vibrate when said note associated with said string is played; and an adjustable stop screw received by each of said threaded apertures for adjusting the distance said pad of said dampening portion can be spaced from said string.

3. In a multi-stringed instrument having a resonating box of a selected size and shape, and a multiplicity of sounding strings adapted for vibration, each of said strings attached by their ends so as to be parallel to each other and to transverse said resonating box such that each string can be tuned to provide notes arranged in a plurality of octaves, the improvement comprising:

a pair of support means mounted to said resonating box parallel to said multiplicity of strings, said pair being mounted so that said multiplicity of parallel strings are located between said parallel pair of support means;

a multiplicity of octave bars having first and further ends and a top side and a bottom side, each of said first and further ends of said octave bar defining a threaded aperture extending through said longitudinal portion from said bottom side to said top side, and being supported by and extending between each of said pair of said support means such that said octave bars are located above and perpendicular to said strings, each of said octave bars being associated with a selected note in each of said plurality of said octaves;

a plurality of control members rigidly attached to each of said octave bars and equal in number to the number of octaves containing said selected note, each of said control members extending from said bottom side of said octave bar through said strings to a dampening portion located below a string corresponding to said note;

resilient means for cooperating with each of said octave bars to urge said dampening portion of said control member against said strings when said string is not being played, and such that said dampening portion of a selected octave bar can be spaced from said string by depressing said selected bar to allow said strings to vibrate when said note associated with said string is played; and an adjustable stop screw received by each of said threaded apertures for adjusting the distance said dampening portion can be spaced from said strings.

4. The improved stringed instrument of claim 2 or 3 wherein each of said stop screws includes a threaded portion and a bearing portion and further includes a multiplicity of guide bearings, one each of said multiplicity of guide bearings being positioned under said first end of each of said longitudinal portion of said octave bars and an other one of said multiplicity of guide bearings being positioned under said further end of each of said longitudinal portion of said octave bars, said guide bearings for receiving said bearing end of said stop screws to prevent wobble of said octave bars.

5. The improved multi-stringed instrument of claim 2 or 3 wherein the number of octave bars is twelve and each of said octave bars represents one of the notes in a standard octave including sharps and flats.

6. The improved multi-stringed instrument of claim 2, wherein said resilient means comprises a pair of compression springs for each of said octave bars, one each of said pair of springs being located at each of said first and further ends between said resonating box and said octave bar.

7. The improved multi-stringed instrument of claim 2, wherein said multi-stringed instrument is an Autoharp.

8. The improved multi-stringed instrument of claim 3 further including a key attached to the top side of each of said octave bars.

* * * * *